US005601389A

United States Patent [19]

Minami

[11] Patent Number: 5,601,389

[45] Date of Patent: Feb. 11, 1997

[54] AUTOMATIC BOOK BINDING MACHINE FOR CUT-SHEETS

[75] Inventor: Isao Minami, Tokyo, Japan

[73] Assignee: Minami Seiki Co., Ltd., Tokyo, Japan

[21] Appl. No.: 391,127

[22] Filed: Feb. 21, 1995

[51] Int. Cl.[6] ..... B42C 13/00

[52] U.S. Cl. ..... 412/14; 412/11; 412/12; 412/13; 412/4

[58] Field of Search ..... 412/4, 8, 11–14; 29/712, 714, 720, 407.04

[56] References Cited

U.S. PATENT DOCUMENTS

| | | | |
|---|---|---|---|
| 3,517,430 | 6/1970 | Williamson et al. | 29/720 X |
| 4,456,379 | 6/1984 | Schumann et al. | 412/11 X |
| 4,484,850 | 11/1984 | Shimizu | 412/11 |
| 4,904,138 | 2/1990 | Champeaux et al. | 412/14 X |
| 5,054,984 | 10/1991 | Chan et al. | 412/11 X |
| 5,112,179 | 5/1992 | Chan et al. | 412/11 X |

FOREIGN PATENT DOCUMENTS

| | | | |
|---|---|---|---|
| 2502547 | 10/1982 | France | 412/11 |
| 1536452 | 1/1970 | Germany | 412/11 |
| 0232465 | 1/1986 | Germany | 412/14 |
| 0246740 | 6/1987 | Germany | 412/11 |
| 1447705 | 12/1988 | U.S.S.R. | 412/14 |

*Primary Examiner*—Frances Han
*Attorney, Agent, or Firm*— Rodman & Rodman

[57] ABSTRACT

An automatic book binding machine for cut-sheets includes a main body, a belt conveyor mounted on the main body and a feeder mounted on the main body and adapted to feed cut-sheets. A front cover of the cut-sheets has an identification mark for identifying one book from other books. A detection sensor is mounted on the belt conveyor for detecting one end of the cut-sheets. A nozzle mounted on the belt conveyor is controlled by the detection sensor to automatically apply a linear band of glue along one edge of the cut-sheets. A first mark sensor is mounted on the belt conveyor to sense a detectable mark on one of the cut-sheets and control the nozzle to stop applying glue to the cut-sheet. A second mark sensor is mounted on the belt conveyor to sense the detectable mark and control the nozzle to resume application of glue to the cut-sheet. A pressing plate is mounted on the main body for stacking up for storage the cut-sheets onto which the linear band of glue has been applied, aligning the sides of each cut-sheet, and pressing the glue-applied areas of the cut-sheets for each book from the top of the front cover in cooperation with the first and second mark sensors.

1 Claim, 1 Drawing Sheet

AUTOMATIC BOOK BINDING MACHINE FOR CUT-SHEETS

BACKGROUND OF THE INVENTION

1. Field of the Invention

This invention relates generally to an automatic book binder or book binding machine, and more particularly to an automatic book binding machine, in which cut-sheets with a single or double surfaces thereof printed are automatically stacked up and book bound.

2. Brief Description of the Related Art

Heretofore, generally two typical methods, as listed below, are known and practiced for book binding cut-sheets by a binding machine.

(a) Wire-Binding

In accordance with this method, cut-sheets are manually held, one bundle or volume at a time, by a worker while aligning the edges of the cut-sheets with his/her hand and then bound by a wire-binding machine.

(2) Perfect-Binding

In accordance with this method, one or several volumes of cut-sheets are manually aligned at edges and inserted into a machine while manually holding them. Then, an adhesive such as a quick-drying hot melt is applied to the back of the book. After the adhesive is dried, the book is manually taken out of the machine.

Also, automatic methods and machines for automatically binding large volumes of standardized books are practiced.

In the above-mentioned typical book binding methods, the worker usually undertakes the troublesome work for manually aligning the edges of the cut-sheets, manually inserting the cut-sheets into and taking them out of the machine, and the like for each book. In the case of the wire-binding, when the thickness of a book is changed depending on the number of the cut-sheets for each book, a complicated and troublesome adjustment of the machine is required to be made each time. On the other hand, in the case of the perfect-binding, although several books can be bound at a time by applying hot melt adhesive thereto when the thickness of each book is small, they are eventually required to be manually separated into each book. Especially, when the number of cut-sheets for each book is small, this separation work is troublesome and inefficient.

In the last-mentioned automatic method and machine, it is large volumes of standardized books that are book bound, and this method and machine are not suited for the production of a wide variety of books (which are different in content, number of pages, etc.) in small volume for each book.

As mentioned above, according to the conventional techniques, the number of book binding process is large and the book binding work must be done manually. Therefore, efficiency is not good. This tendency is more significant for books which are different in number of pages.

The present invention has been accomplished in view of the above problems inherent in the conventional techniques.

SUMMARY OF THE INVENTION

It is, therefore, a general object of the present invention to provide an automatic book binding machine in which books can be automatically correctly bound in an efficient manner.

Another object of the invention is to provide an automatic book binding machine in which many books can be automatically bound at a time.

A further object of the invention is to provide an automatic book binding machine which is suited to be used for the production of a wide variety of books (which are different in content, number of pages, etc.) in small volume for each book.

A still further object of the invention is to provide an automatic book binding machine which can be used not only for binding books, but also for binding documents, bills and the like.

A yet further object of the invention is to provide an automatic book binding machine, in which man power can be greatly saved.

In order to achieve the above objects, there is essentially provided an automatic book binding machine for cut-sheets, comprising a main body; a belt conveyor mounted on the main body, the belt conveyor including a plurality of rollers and a plurality of belts, the belts being arranged in at least two rows; a feeder mounted on the main body at an entrance of the belt conveyor and adapted to feed cut-sheets stored therein, the cut-sheets comprising a front cover, an inner body and a back cover which are printed and gathered in a predetermined order, the front cover being applied with an identification mark for identifying one book from others; a detection sensor mounted on the belt conveyor and capable of detecting one end of the cut-sheets; a nozzle mounted on the belt conveyor and controlled by the detection sensor to automatically linearly apply a glue to and along one edge of the cut-sheets; a first mark sensor mounted on the belt conveyor on a front side of the detection sensor and capable of reading a detectable mark on one of the cut-sheets, so that upon detection of the detectable mark by the first mark sensor, the nozzle is controlled to stop application of the linear glue to the cut-sheet marked with the predetermined mark; a second mark sensor mounted on the belt conveyor at the rear side of the detection sensor and capable of detecting the detectable mark, so that upon detection of the detectable mark by the second mark sensor, the nozzle is controlled to resume application of the linear glue; and a pressing plate mounted on the body at an exit of the conveyor for stacking up for storage the cut-sheets onto which the linear glue is already applied, in a predetermined order while aligning four sides of each cut-sheet, and pressing the glue-applied areas of the cut-sheets for each book from the top of the front cover in operative connection with the first and second mark sensors.

When a book consisting of, for example, ten cut-sheets P, are to be bound, the first cut-sheet $P_1$ serving as a front cover, the intermediate cut-sheets $P_2$ to $P_9$ as a main body, and the last cut-sheet $P_{10}$ as a back cover are preliminary gathered in a predetermined order in the feeder 10 located at one end of the machine body 1 and then fed, one-by-one, onto the roller conveyor A by the feeder 10 first with the back cover $P_{10}$, then with the intermediate cut-sheets (main body) $P_2$ to $P_9$ and finally with the front cover $P_1$. First, when one edge of the front cover $P_{10}$ among the cut-sheets P is detected by the sensor 7, a predetermined length of linear glue 12 is discharged from the nozzle 8. Then, all the cut-sheets $P_9$, $P_8$ . . . excepting the cut-sheet $P_1$ are gradually applied with the linear glue 12 and discharged, by the discharge rollers 3 and 3*a*, for gathering into the storage portion 4 through the exit formed at a distal end of the machine body 1. When the last cut-sheet $P_1$ on which the identification mark 5 is marked, is transferred, this identification mark 5 is detected by the mark sensor 6. Upon detection of the mark 5, the mark sensor 6 brakes the output from the nozzle 8. Therefore, all the glue-attached cut-sheets P only excepting the front cover $P_1$ are transferred as they are. When the front cover $P_1$ passes nearby, the mark sensor 9 detects the identification mark 5 which is preliminary marked on the front cover $P_1$ and remove the braking with the nozzle 8. Then, the cut-sheets P for each book are gathered in the storage portion 4 and only the linear glue-attached portions are press-finished by the pressing plate 11. After the linear glue 12 is applied to all the cut-sheets P excepting the cut-sheet $P_1$, the cut-sheets P are finally received in the form of a book in the storage portion 4 and then press-finished by a pressing plate 11. The second and third book are bound in the same manner.

The foregoing has outlined some of the more pertinent objects of the present invention. These objects should be construed as being merely illustrative of some of the more prominent features and applications of the invention. Many other beneficial results can be obtained by applying the disclosed invention in a different manner or modifying the invention within the scope of the invention. Accordingly, other objects in a full understanding of the invention may be had by referring to the summary of the invention, the detailed description describing the preferred embodiment in addition to the scope of the invention defined by the claim taken in conjunction with the accompanying drawings.

DETAILED DESCRIPTION OF THE EMBODIMENT

One preferred embodiment of an automatic book binding machine for cut-sheets according to the present invention will now be described in detail with reference to the accompanying drawings. The preferred embodiment herein described is not intended to be exhaustive or to limit the invention to the precise form disclosed. It is chosen and described to explain the principles of the invention, its application and its practical use to enable others skilled in the art to utilize the invention.

Figure 1:
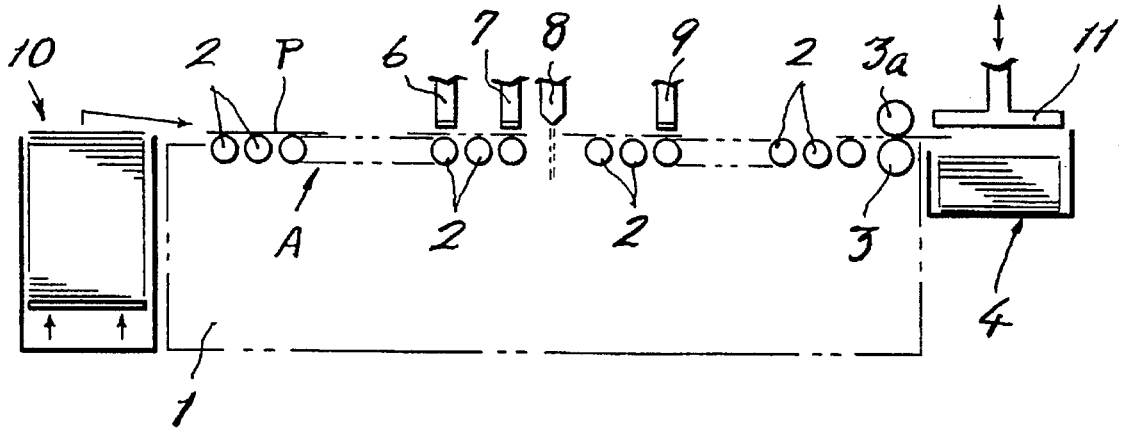
FIG. 1 is a schematic view for explaining an automatic book binding machine for cut-sheets according to one embodiment of the present invention.

In FIG. 1, reference numeral 1 denotes a machine body, on which a roller conveyor A provided with a plurality of rollers 2, 2 . . . , and a pair of discharge rollers 3 and 3*a* disposed at an exit of the roller conveyor A. On the discharge rollers 3 and 3*a* side at the exit of the machine body 1, a storage portion 4 for cut-sheets discharged by the discharge rollers 3 and 3*a* is provided.

At an upper part of a path of the conveyor A, there are further provided a mark sensor 6 for detecting an identification mark 5 marked on a front cover $P_1$ among cut-sheets P as later described, a sensor 7 for detecting an edge portion of each cut-sheet P conveyed on the roller conveyor A, a nozzle 8 for discharging an adhesive glue, and a mark sensor 9 disposed at a rear side of the nozzle 8 and adapted to detect the identification mark 5 marked on the front cover $P_1$ to remove the prohibition of output from the nozzle 8. It should be noted here that the first-mentioned mark sensor 6 is adapted to detect the mark which is preliminarily marked on one of the cut-sheets in order to stop the nozzle 8 from discharging the adhesive glue to the cut-sheet bearing the mark.

A feeder 10 for storing therein a stack of cut-sheets P which are gathered in a predetermined order is disposed at an entrance which is formed at one end of the machine body 1. At an upper part of the storage portion 4 at the exit which is formed at the other end of the machine body 1, there is provided a pressing plate 11 for pressing a linear glue-attaching area 12 which is braked upon detection of the identification mark 5 by the mark sensor 6 when the cut-sheets P for each book are discharged.

Figure 2:
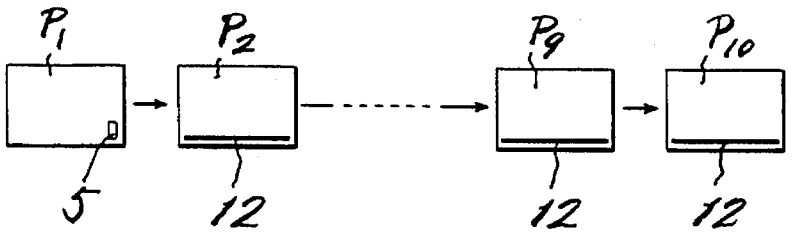
FIG. 2 is a development view showing a construction of each cut-sheet constituting a book, as well as glue-applied areas.
Figure 3:
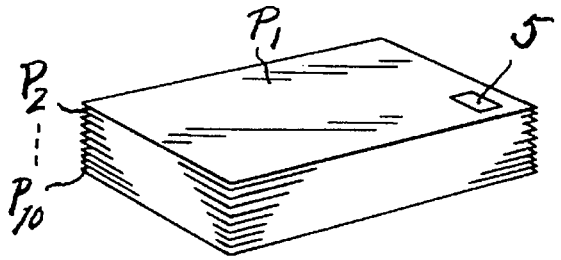
FIG. 3 is a perspective view of a finished book which has been bound in accordance with the teachings of the present invention.

In case books each consisting of, for example, ten cut-sheets P, are to be bound, as shown in FIG. 2, the first cut-sheet $P_1$ is served as a front cover, the intermediate cut-sheets $P_2$ to $P_9$ are served as an inner body, and the last cut-sheet $P_{10}$ is served as a back cover for each book. As shown in FIG. 2, the cut-sheets P are fed, one-by-one, onto the roller conveyor A first with the back cover $P_{10}$. After the linear glue 12 is applied to all the cut-sheets P excepting the cut-sheet $P_1$, the cut-sheets P are finally received in the form of a book in the storage portion 4 and then press-finished by a pressing plate 11. The second and third book are bound in the same manner.

As described in the foregoing, according to the present invention, the cut-sheets are automatically fed, one-by-one, onto the roller conveyor from the feeder and a required number of cut-sheets are applied with a glue through detection of the identification mark. Since this book-binding is performed automatically correctly whether the number of pages is large or small, a separation work is no more required and man power can be greatly saved. Especially, when cut-sheets, which have been gathered in a predetermined order during the process of being printed by a cut-sheet printer operatively connected with a computer, are to be processed in accordance with the teaching of the present invention, those books, which are required to be bound in a small volume per each book (or document, bill or the like) having different contents, number of pages and the like, can be bound efficiently and correctly (this was impossible in the prior art).

It is to be understood that the form of the invention herewith shown and described is to be taken as the preferred embodiment of the same, and that various changes in the shape, size and arrangement of parts may be resorted to without departing from the spirit of the invention or the scope of the subjoined claim.

What is claimed is:

1. An automatic book binding machine for cut-sheets, comprising:

a main body;

a belt conveyor mounted on said main body, said belt conveyor having an entrance and an exit and including a plurality of rollers and a plurality of belts, said belts being arranged in at least two rows;

a feeder for cut-sheets, wherein the cut-sheets have four sides and selectively include a detectable mark to govern application of glue to the cut-sheets, a front cover, an inner body and a back cover printed and sorted in a predetermined order, with the front cover having an identification mark for identifying one book from other books, said feeder being mounted on the main body at the entrance of said belt conveyor and adapted to feed cut-sheets stored therein;

a detection sensor mounted on said belt conveyor for detecting one end of the cut-sheets, said detection sensor having front and rear sides;

a nozzle mounted on said belt conveyor and controlled by said detection sensor to automatically apply a linear band of glue along one edge of the cut-sheets;

a first mark sensor mounted on said belt conveyor on the front side of each said detection sensor for detecting a detectable mark and in response to such detection, controlling the nozzle to stop application of glue to the cut-sheets;

a second mark sensor mounted on said belt conveyor at the rear side of said detection sensor for detecting said detectable mark and in response to such detection, controlling the nozzle to resume application of glue to the cut-sheets; and a pressing plate mounted on said main body at the exit of said conveyor for stacking up for storage the cut-sheets onto which the linear band of glue has been applied, in a predetermined order while aligning the four sides of each cut-sheet and pressing the glue-applied areas of the cut-sheets for each book from the top of said front cover in cooperation with said first and second mark sensors.

* * * * *